US005892329A

United States Patent [19]

Arkhipov et al.

[11] Patent Number: 5,892,329

[45] Date of Patent: Apr. 6, 1999

[54] PLASMA ACCELERATOR WITH CLOSED ELECTRON DRIFT AND CONDUCTIVE INSERTS

[75] Inventors: Boris A. Arkhipov, Kaliningrad Oblast; Vitaly V. Egorov; Vladimir Kim, both of Moscow; Vyacheslav I. Kozlov, Tarusa, Kaluzskaja oblast; Nicolay A. Maslennikov, Kaliningrad Oblast; Sergei A. Khartov, Moscow, all of Russian Federation

[73] Assignee: International Space Technology, Inc., Palo Alto, Calif.

[21] Appl. No.: 862,640

[22] Filed: May 23, 1997

[51] Int. Cl.[6] ..... H01J 41/12

[52] U.S. Cl. ..... 315/111.11; 315/111.61; 313/362.1; 60/202

[58] Field of Search ..... 315/111.61, 111.91; 60/202, 203.1; 313/231.31, 359.1, 362.1

[56] References Cited

U.S. PATENT DOCUMENTS

| | | | |
|---|---|---|---|
| 5,218,271 | 6/1993 | Egorov et al. | 315/111.61 |
| 5,359,258 | 10/1994 | Arkhipov et al. | 313/359.1 |
| 5,689,950 | 11/1997 | Smith | 60/202 |

FOREIGN PATENT DOCUMENTS

| | | | |
|---|---|---|---|
| 463408A2 | 1/1990 | European Pat. Off. | H05H 1/54 |
| 0 637 689 A2 | 2/1995 | European Pat. Off. | 60/202 |
| 0781921A1 | 7/1997 | European Pat. Off. | F03H 1/00 |
| 09041148 | 10/1997 | Japan | C23C 16/50 |
| WO 94/02738 | 2/1994 | WIPO . | |

OTHER PUBLICATIONS

Artsimovitch, L., "Investigation of Plasma Systems With Closed Electron Drift and a Distributed Electric Field", in *Plasma Accelerators,* Moscow, Mashinostroenie, 1974. (full English translation), pp. 75–84.

Bober, A.S. & Maslennikov, N.A., "SPT in Russia—New Achievements", *Proceedings of the 25th International Electric Propulsion Conference (IEPC)*, Paper No. 95–06, vol. 1, Moscow, Russia, 1995, pp. 54–60.

Bober, A.S., et al., "State of Works on Electrical Thrusters in the USSR", *Proceedings of the 22nd IEPC,* Paper No. 91–003, Viareggio, Italy, Oct. 14–17, 1991.

Garkusha, V.I., et al., "Anode Layer Thrusters, State–of–the–Art and Perspectives", *Proceedings of the 23rd IEPC,* Paper No. 93–228, vol. 3, Seattle, WA, 1993, pp. 2120–2124.

Kim, V., et al., "Investigation of the SPT Performance Improvement Possibility", *Proceedings of the 25th IEPC,* Paper No. 95–45, vol. 1, Moscow, Russia, 1995, pp. 352–354.

Semenkin, A.V., "Investigation of Erosion in Anode Layer Thruster and Elaboration High Life Design Scheme", *Proceedings of the 23rd IEPC,* Paper No. 93–231, vol. 3, Seattle, WA, 1993, pp. 2134–2139.

*Primary Examiner*—Robert Pascal
*Assistant Examiner*—Justin P. Bettendorf
*Attorney, Agent, or Firm*—Fenwick & West LLP

[57] ABSTRACT

A plasma accelerator with closed electron drift comprising a dielectric discharge chamber (6) with internal and external annular walls (13) forming an annular accelerating channel, and a magnetic system with sources (3) of a magnetic field, a magnetic path (2), external (4) and internal (5) magnetic poles forming an operating gap in the region of the discharge chamber exit edges. An anode unit (7) with a gas distributor is located in the accelerating channel interior, and the distance from the anode-gas distributor (7) to the accelerating channel exit plane exceeds said channel width. A cathode-compensator (1) is located beyond the exit plane of the discharge chamber (6). Exit parts of the discharge chamber walls (13) facing the accelerating channel are made of conducting material. At least one dividing annular groove (12) is made on each chamber wall between its conducting and main parts. Conducting parts of the discharge chamber walls are made as annular inserts (8, 9) out of material resistant to ion sputtering. This invention increases accelerator efficiency, and decreases the sputtering rate of the plasma accelerator components as well as accelerator plume divergence.

15 Claims, 3 Drawing Sheets

PLASMA ACCELERATOR WITH CLOSED ELECTRON DRIFT AND CONDUCTIVE INSERTS

TECHNICAL FIELD

The present invention relates to the field of plasma technology and, more particularly, to Accelerators with Closed Electron Drift (ACED) used as Electric Propulsion Thrusters (EPT), or to ion plasma material surface treatment in a vacuum.

BACKGROUND ART

There are known plasma thrusters or "accelerators" with a closed electron drift which are used for various technical applications. See L. Artsimovitch, "Plasma accelerators", Moscow, *Mashinostroenie,* 1974, pp. 54–95.

One such accelerator with closed electron drift has an extended accelerator region (ACEDE: Accelerator with Closed Electron Drift that has an extended acceleration region) and comprises a dielectric discharge chamber with an annular accelerating channel, the exit part of which is between two magnetic poles. This accelerator also includes an anode-gas distributor located deep inside the accelerating channel. See L. Artsimovitch, "Plasma accelerators", Moscow, *Mashinostroenie,* 1974, pp. 75–81. Another accelerator of ACED type is known as an anode layer accelerator (ALA). It has a metal discharge chamber and a shortened acceleration region.

The main difference between ACEDE and ALA is that ACEDE accelerators have a fundamentally nonuniform magnetic field in a relatively long accelerating channel, the walls of which limit accelerated plasma flow. See A. Bober, V. Kim, et al., "State of Work on Electrical Thrusters in the USSR", AIAA Paper IEPC-91-003, 6 pp. The following ratios define ACEDE and ALA parameters:

$$\text{ACEDE}: L_C/L_B \sim 1, L_C/b_C \geqq 1, b_O/b_C \sim 1$$

$$\text{ALA}: L_C/L_B < 1, L_C/b_C < 1, b_O/b_C < 1 \quad (1)$$

Where:

- $L_C$ and $L_B$ are the length of the accelerating channel and length of the region with a sufficiently high value of magnetic induction, respectively.
- $b_C$ and $b_O$ are the width of the accelerating channel and characteristic radial dimension of the flow in acceleration region, respectively.

The above mentioned differences are significant, as they define differences in the operation processes of the respective accelerators. In particular, potential distribution in the accelerating channels of the ALA accelerator (in both one-stage and two-stage designs) are determined mainly by external voltage sources, and electrode (anode and cathode) positions, defining the lengthwise dimensions of the acceleration stages.

The location of the ionization and acceleration layer (IAL) in the ACEDE accelerator is a function of the magnetic field distribution in the accelerating channel and interaction of the plasma flow with the discharge chamber walls. Thus, unlike ALA accelerators, the distribution of the electric field in the larger part of the ACEDE accelerating channel is created without significant impact of electrodes' positions.

Another known plasma accelerator with a closed electron drift comprises a dielectric discharge chamber with annular external and internal walls to form an accelerating channel, a magnetic system with magnetic field sources, a magnetic path, external and internal magnetic poles to form an operating gap at the exit part of the discharge chamber walls, a gas distributor-anode situated inside the accelerating channel at a distance from the exit plane of the discharge chamber exceeding the width of the accelerating channel, and a cathode-compensator. See A. Bober, V. Kim, et al., "State of Work on Electrical Thrusters in the USSR", AIAA Paper IEPC-91-003, 6 pp. Integral parameters of this device permitted to design thrusters for use on spacecraft and accelerators for ground applications based on its design.

However, the known thruster does not have an efficiency and lifetime sufficient for many missions due to discharge chamber wall sputtering by accelerated ions, and considerable plume divergence. Thus, efficiency of the contemporary ACEDE (type SPT-100) does not exceed 50%, and its lifetime is 7,000 hours at an exhaust velocity of ~16 km/sec. In this case, plume divergence half angle $\beta_{0.95}$ is ~45° for 95% of accelerated ions in the exhausting flow.

Still another known plasma thruster with a closed electron drift comprises a dielectric discharge chamber with annular external and internal walls to form an accelerating channel, a magnetic system with magnetic field sources, a magnetic path, external and internal magnetic poles, an anode unit with a gas distributor, and a cathode-compensator. In this case, part of one of the walls is made of electric conducting material. See the international patent application WO 94/02738, published Feb 3, 1994, F03H1/00, H05H1/54. The efficiency and lifetime of this plasma accelerator is also limited by insufficient focusing of the ion flow, which also causes significant energy losses and ion sputtering of accelerator components.

DISCLOSURE OF INVENTION

The present invention is a plasma accelerator with a closed electron drift comprising a dielectric discharge chamber (6) with annular external and internal walls (13) partially made of conducting material to form an accelerating channel; a magnetic system with the sources (3) of the magnetic field, a magnetic path (2), and external and internal magnetic poles (4,5) to form an operating gap at the exit part of the discharge chamber walls (13); an anode unit (7) with a gas-distributor situated inside the accelerating channel at a distance from the exit plane of the discharge chamber (6) that exceeds the width of the accelerating channel; and a cathode-compensator (1), in which exit parts of the discharge chamber facing the accelerating channel are made of conducting material, and there is at least one annular groove (12) on a dielectric part of the chamber wall (13), said groove (12) dividing conducting and dielectric surfaces.

Intensive interaction of plasma flow with the discharge chamber walls decrease the efficiency and lifetime of the accelerator. The plasma accelerator of the present invention includes conductive inserts (8,9) located adjacent the dielectric part of discharge chamber (6), which reduce the amount of ion bombardment of the discharge chamber walls (13), which increase accelerator efficiency and lifetime, and which decrease the plume divergence.

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF THE PREFERRED EMBODIMENTS

Figure 1:
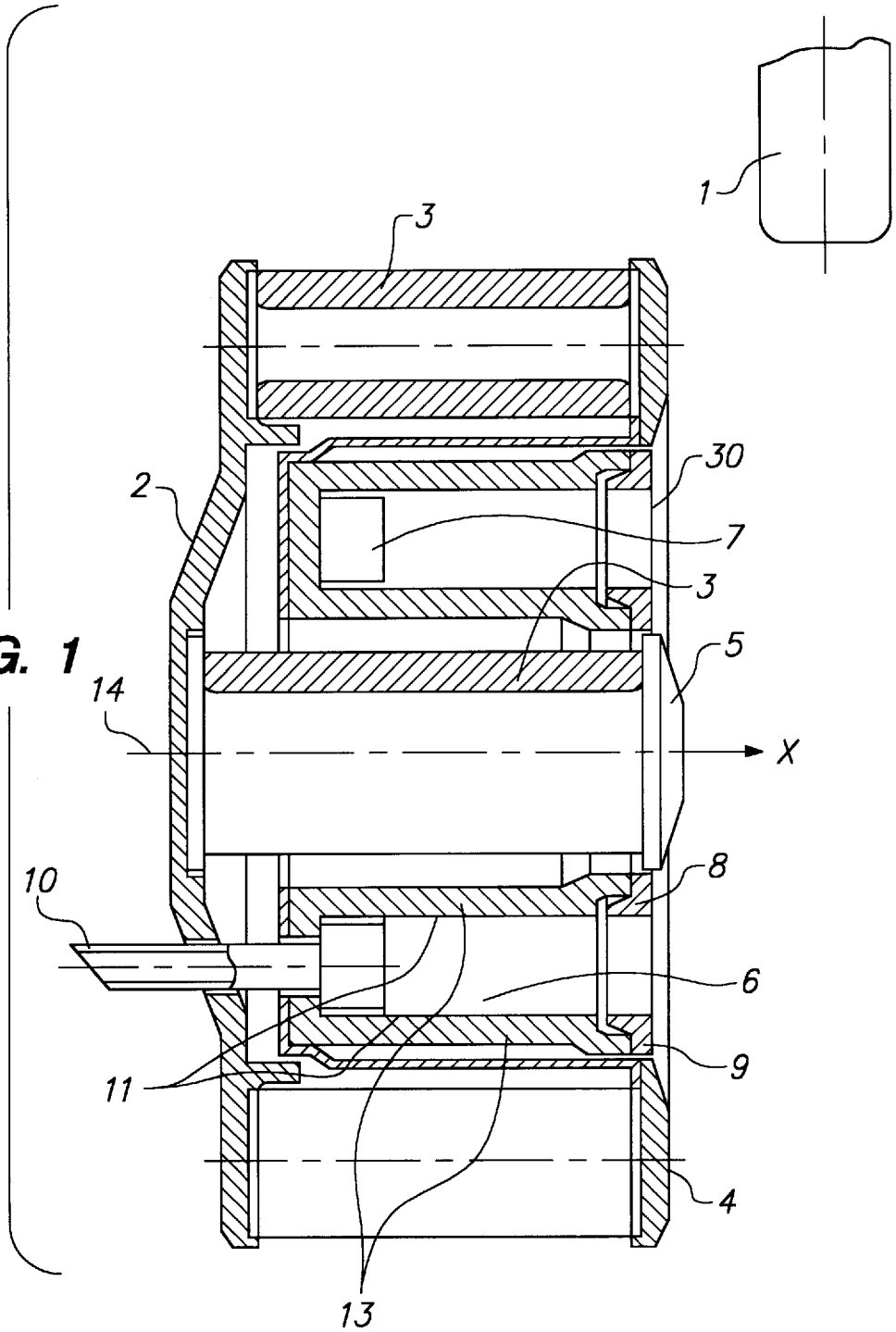
FIG. 1 is a cross section view of a preferred embodiment of the accelerator.
Figure 2:
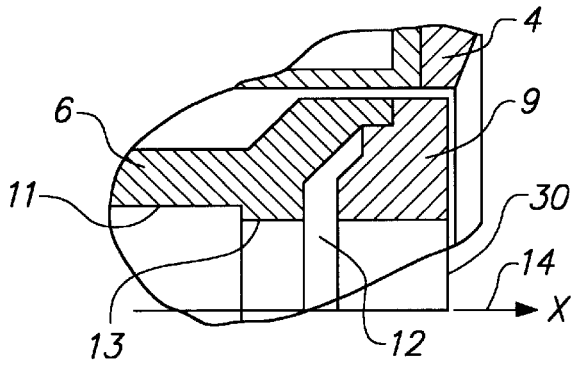
FIG. 2 is a schematic cross section view of the annular dividing grooves and location of the conducting inserts.

Referring now to FIG. 1, a preferred embodiment of an accelerator with closed electron drift is comprised of: cathode-compensator 1, magnetic path 2, main sources 3 of the magnetic field, external annular pole 4, internal annular pole 5, dielectric discharge chamber 6, anode-gas distributor 7 (in this embodiment the anode and gas distributor are designed as one unit, although they may be separate units), internal insert 8 and external insert 9 manufactured out of electrically conductive material with high resistance to sputtering from accelerated ions, and a gas supply tube 10. Walls of the main part of the discharge chamber are made of or coated with a material 11 with high adhesion capability to facilitate the condensation of materials sputtered from the conducting inserts 8, 9. The conducting inserts 8, 9 are in contact with the accelerated ion flow and the flow causes their sputtering. Conducting inserts are divided from the main part of the discharge chamber by annular dividing grooves 12 (FIG. 2). The distance between the parts of discharge chamber walls closest to the dividing grooves 12 and the central (imaginary) plane 14 of the accelerating channel 6 is equal or less than the corresponding distances between the central plane 14 and the inserts 8, 9. The dividing grooves 12 are configured such that a straight line connecting (1) any point on a conductive part of a discharge chamber wall opposite a dividing annular groove with (2) a point on another conductive part that defines at least a portion of the dividing annular groove crosses a part of a wall volume forming the dividing annular groove.

Figure 3:
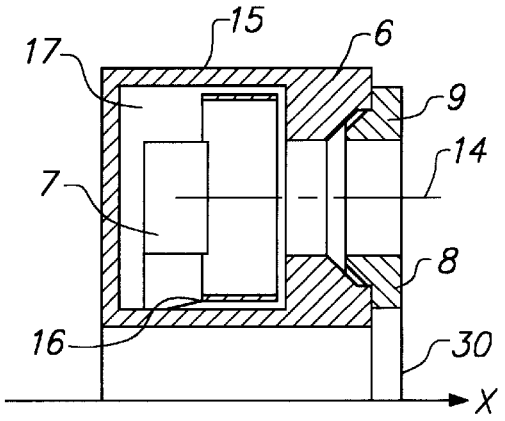
FIG. 3 is a cross section view of the discharge chamber with additional annular grooves and screens.
Figure 4:
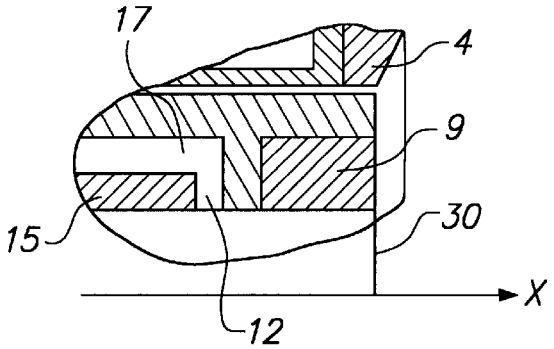
FIG. 4 is a schematic cross section view of an alternate embodiment of the annular dividing grooves and screens.
Figure 5:
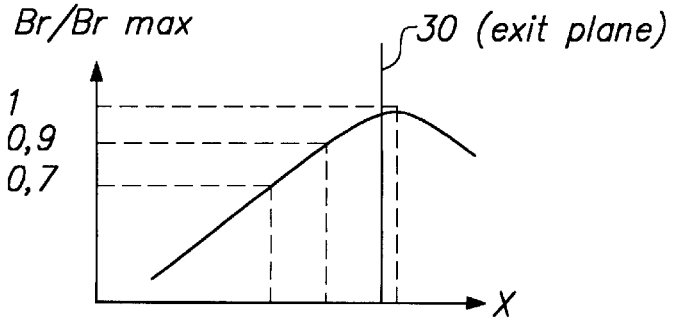
FIG. 5 shows value distribution of the transverse component $B_r$ of the magnetic field induction along the accelerating channel in its central (imaginary) surface.

In one embodiment, the accelerator includes additional annular screens 15 and 16 (FIG. 3) located in the annular grooves 17. There is a gap between the annular screens 15 and 16 and the walls of the discharge chamber 6, thereby creating additional grooves (17). When additional annular grooves and screens are designed, dividing grooves 12 may become shorter or be eliminated (FIG. 4). The preferable length of the conducting inserts 8, 9 is such that the inserts 8, 9 are located in the region between channel cross sections, within which the values of the component $B_r$ of the magnetic field induction transverse to the acceleration direction change in the central surface from the value of ~0.9 $B_{r\ max}$ to the value of $B_{r\ max}$, where $B_{r\ max}$ is the maximum value of $B_r$ on the aforementioned surface (FIG. 5). If there are additional annular grooves 17 and screens 15, 16, the sides of the screen closest to the discharge chamber exit plane 30 are located in the region between channel cross sections, within which the values of the transverse constituent of the magnetic field induction $B_r$ change from the value of 0.7 $B_{r\ max}$ to the value of 0.85 $B_{r\ max}$.

Figure 6:
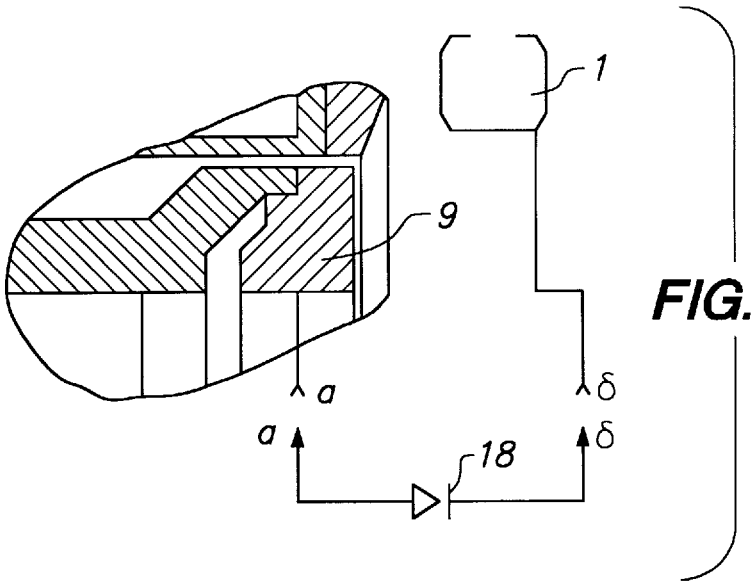
FIGS. 6–9 show alternate schematics for electric connection between conducting inserts and cathode-compensator.
Figure 7:
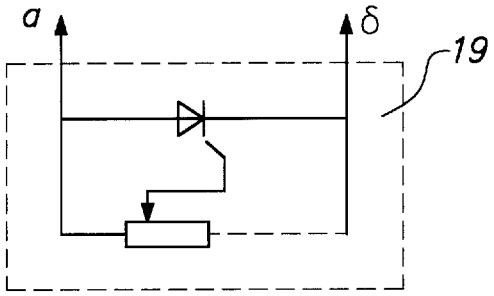
Figure 8:
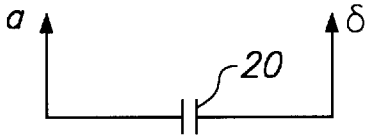

For more active impact on the processes in the accelerator, the conducting inserts 8, 9 could be electrically connected with cathode-compensator 1 by a rectifying component which permits current in the direction from the inserts to the cathode-compensator 1. This component may be a diode 18 (FIG. 6) or a rectifying component 19 with an adjustable range of filtration (FIG. 7). Strong impact may also occur if conducting inserts are electrically connected with the cathode-compensator 1 by a component which has a low total resistance to AC within the range 5 kHz to 250 kHz, and high total resistance to DC. Such a component may be either a capacitor 20 (FIG. 8) or schematic of an LC filter 21 (FIG. 9) with capacitor C and inductor L connected in series.

The accelerator operates in the following way. The sources 3 of the magnetic field (e.g., magnetization coil) create a mainly radial magnetic field (transverse to the acceleration direction) in the acceleration channel of the discharge chamber 6 in the region of the magnetic poles 4 and 5. The working gas (e.g., xenon) is supplied to the discharge chamber through anode-gas distributor 7 (there may be alternate variants for gas supply). Discharge voltage is applied between anode 7 and cathode 1, and a discharge is ignited in the working gas flow. The radial magnetic field prevents free electron movement in the linear electric field between cathode 1 and anode 7. The existence of crossed electric and magnetic fields causes an electron drift along the azimuth. The collisions of the drifting electrons with particles and channel walls, as well as the oscillation processes in plasma, causes the electrons to diffuse to the anode 7. Drifting electrons ionize atoms of the working gas. Voltage applied between anode 7 and cathode 1 creates an electric field in the formed plasma. This field accelerates ions mainly in the axial direction. The ion flow formation and acceleration mainly occur in the region of maximal magnetic field. This region is located at the discharge chamber 6 exit plane and is called ionization and acceleration layer (IAL). Operating processes in this layer determine accelerator efficiency and lifetime.

ACEDE integral parameters are largely determined by the topology and value of the magnetic field in the accelerating channel, and the parameters remain constant even when the exit part of the discharge chamber is considerably widened as a result of ion sputtering. Noticeable decrease of accelerator efficiency is witnessed only when discharge chamber walls 6 are completely sputtered in the interpolar gap (FIG. 1) of the magnetic system and when poles 4 and 5 are considerably sputtered. Erosion of the exit parts of the discharge chamber 6 caused by accelerated ion bombardment is the main process that determines the lifetime of the accelerator. Undesirable variations in the size and strength of the magnetic field is the main cause of the above mentioned decrease of efficiency.

Installation of inserts 8 and 9 made of conducting material with high resistance to accelerated ion sputtering on the exit parts of discharge chamber walls increases efficiency and prolongs the lifetime of the accelerator. Implementation of inserts 8, 9 with low floating potential values increase potential shift of the discharge chamber wall relative to the potential of the plasma layers adjacent to this wall, which leads to a decrease in intensity of electron interaction with the wall. Consequently, "parasite" electron flow near the wall along the channel could be decreased to the optimal value, longitudinal length of IAL could be decreased in the exit direction, and total ion flow to the discharge chamber walls drops drastically. This leads to an improved ion flow focusing (values of $\beta_{0.95}$ decreases by ~1.5 times), improved thrust efficiency, and prolonged lifetime of the accelerator. Dimensions of the inserts 8 and 9 (FIG. 2) are chosen in such a way that they are located between channel cross sections, within which the values of the component $B_r$ of the magnetic field induction transverse to the plasma acceleration direction are between 0.9 $B_{r\ max}$ and $B_{r\ max}$, respectively on the (imaginary) central channel surface (where $B_{r\ max}$ is the maximum value of the magnetic field induction on the aforementioned surface). It happens so that the ionization and acceleration layer, which is the region of maximum electric field values, is located in the region with maximum $B_r$ values. Thus, such location of inserts allows the plasma to contact the inserts 8, 9 in the IAL, thus providing the desired result.

Constriction of the ionization and acceleration layer is caused by a decrease in intensity of electron interaction with the discharge chamber walls. This is proved by a known ratio for longitudinal length of the IAL:

$$\delta = R_{Le}(\nu_{eo}/\nu_i)^{1/2} \quad (2)$$

Where $R_{Le}$ is Larmor electron radii calculated for electron energy corresponding to the discharge voltage and magnetic field induction of the operating regime.

$\nu_{eo}$ is total frequency of electron collisions, determined by the sum of electrons collision frequencies with ions ($\nu_{ei}$), atoms ($\nu_{ea}$), discharge chamber walls ($\nu_{cw}$) and effective frequency ($\nu_{eff}$) corresponding to the oscillations.

$\nu_i$ is frequency of ionization collision.

The dominant component of $\nu_{eo}$ is $\nu_{ew}$. Thus, the drastic reduction of the IAL causes $\delta$ to decrease considerably (experiments by the inventors have shown a decrease of up to two times) and to optimize the longitudinal election current component value in the channel. Such reduction occurs only when the inserts 8, 9 are located in the region of maximum values of the magnetic field induction. Experiments by the inventors have confirmed that the desired result is achieved when inserts are located in the region where $B_r$ values vary from between 0.9 $B_{r\ max}$ and $B_{r\ max}$ (from the anode side). Specifically, the inventors achieved an increase of thrust efficiency by 5–10% (from the initial level of 40–50%), a decrease of linear rates of erosion by at least two times, and a decrease of $\beta_{0.95}$ by approximately 1.5 times.

Graphite or graphite based materials may be used to manufacture conductive inserts 8, 9, as these materials have high resistance to accelerated ion sputtering. Experiments by the inventors have shown that if all the above mentioned actions are implemented accelerator lifetime can be increased by more than two times.

As a result of insert sputtering, the sputtered material deposits on the internal surfaces of the discharge chamber walls 13. This changes electric properties of the walls 13 and accelerator parameters. It is necessary to electrically insulate the inserts 8, 9 from such deposit coating, or otherwise the time that the accelerator operates with high efficiency is limited to the time required to form an equipotential coating which bypasses plasma in the discharge region from anode 7 to inserts 8, 9. To prevent this phenomenon, dividing annular grooves 12 are made on chamber walls 6 from the side (see FIG. 2) facing the accelerated channel between chamber wall regions with inserts 8 and 9 and other discharge chamber surfaces forming accelerating channel. In this case, grooves 12 are manufactured in such a way so that a straight line connecting any point on any conducting insert 8 or 9 surface facing the accelerating channel with points on at least some annular parts of the surfaces forming dividing grooves 12 on the opposite wall shall cross at least part of wall volume forming the corresponding annular grooves 12. That is, at least part of surfaces forming grooves 12 shall be located outside direct vision from any point on the aforementioned insert 8, 9 surfaces facing accelerating channel and located on the opposite wall. This prevents electrical connection of the inserts 8, 9 with other parts of the discharge chamber 6 caused by deposition of the insert sputtered material. Besides, longitudinal length $\delta_K$ of the grooves 12 shall exceed the thickness of the coating, resulting from the deposition of sputtered material on the surfaces binding the grooves 12, that might form during total operation time of the accelerator. These grooves 12 are also an obstacle for electron drift along the wall, and, as a result, energy loss in the accelerator is decreased. The groove 12 becomes an obstacle if the value of its length along the accelerating channel is $\delta_K \geqq R_{Le}$, where $R_{Le}$ is Larmor electron radii calculated for electron energy corresponding to the discharge voltage and magnetic field induction of the operating regime. Additional grooves may be created to decrease current near the chamber walls.

Experiments and analysis by the inventors indicate that reliable insulation of the conducting areas of the discharge chamber walls 13 may be achieved if additional annular grooves 17 (FIG. 4) are provided on the walls 13 of the discharge chamber 6 between the aforementioned areas and the anode, and if annular screens 15 and 16 are installed in the annular grooves with a gap (FIG. 3) between the annular groove 17 and the discharge chamber walls 13. The main annular dividing grooves 12 (FIG. 2) are not required if there are additional annular grooves 17 and screens 15, 16 (FIG. 4). In addition, the distance between the central surface of the accelerating channel 6 and these screens 15, 16 shall exceed the distance between this surface and areas of the discharge chamber walls 13 located between additional annular groove 17 and conductive inserts 8 and 9 (FIGS. 3, 4). The gap (FIG. 4) is large enough such that it will not be closed up by sputtering materials during the operation of the accelerator.

As previously stated, sputtered material deposits on the walls 18 of the discharge chamber 6 during accelerator operation. Cracking of deposited coating flakes may occur when accelerator operates in cycles, and such cracking causes temporary disturbances in the operating processes, resulting in increased discharge current and decreased efficiency. Additionally, the local uniformity of the electric properties of the IAL is a result of coating cracking from the chamber walls 13. This causes plasma instability, which in turn results in decreased efficiency. The parts of the discharge chamber walls 13 facing the acceleration channel 6 are made of or coated with a material 11 (FIG. 1) having a high adhesion ability to condensing material sputtered from the inserts 8, 9 to decrease the impact of cracking. In particular, it is possible to apply a graphite sublayer on the discharge chamber walls 13 (surfaces facing the acceleration-channel 6), except for the surfaces forming dividing grooves 12, if the inserts are made of graphite.

One of the ways to control the intensity of electron interaction with the discharge chamber walls 13 in the ionization and acceleration layer is to optimize the distance between the conducting inserts 8, 9 and the central surface of the accelerating channel. To achieve this, the distance between the central surface 14 of the acceleration channel 6 and inserts 8, 9 shall equal or exceed the distance from the mentioned central surface 14 to the closest to it dielectric parts 13 of the discharge chamber walls 6 which are also adjacent to the surfaces bounding the grooves from the side of the anode-gas distributor 7.

Ion flow focusing can be improved by altering the operating process in the near anode region of the discharge chamber 6. In particular, potential distribution can be adjusted in the discharge chamber 6, and thus decrease corresponding losses. Additionally, oscillation intensity in this area can be also decreased. Experiments show the aforementioned improvements can be achieved if screens 15 and 16 are made of conducting material. In this case, sides of the screens 15, 16 shall be located adequately close to conductive inserts 8, 9 (FIGS. 3, 4) specifically between cross sections where $B_r$ values are 0.7–0.85 $B_{r\ max}$ on the central surface of the acceleration channel 6 equidistant from the chamber walls (FIG. 5). Naturally, location of the aforementioned sides shall be in accordance with the length of the main conductive inserts 8,9. That is, if the length of the conductive inserts 8, 9 is such that their sides closest to the anode 7 are located in the cross section where $B_r$=0.9 $B_{r\ max}$, then, naturally, screen sides can be located only in the cross section closer to the anode 7, for example, in the cross section where $B_r \leqq 0.8\ B_{r\ max}$.

It is also preferable that the distances from screen surfaces 15, 16 to the central surface 14 of the acceleration channel 6 be longer than distances from screen 15, 16 surfaces to the surfaces of the walls 13 of the main part of the discharge chamber 6 (see FIG. 4) located between inserts 8, 9 and screens 15, 16. The screens 15, 16 must be made of material with high adhesion ability to the material sputtered from the inserts 8, 9 due to aforementioned reasons. Experiments show when inserts 8,9 are made of graphite, the screens 15 and 16 may also be made of graphite or stainless steel either with or without a thin graphite sublayer. It is also important that a gap exist between the surfaces of the screens 15, 16 of the discharge chamber walls 13, thereby forming additional grooves 17. The gap protects the walls of the main part of the discharge chamber 6 from the material sputtered from the inserts 8, 9.

Installing the conductive inserts 8, 9 decreases oscillation intensity in the ionization and acceleration layer caused by periodic decompensation of the volumetric charge in this layer due to inevitable ion and electron flow pulsations in this layer. This is one factor that causes δ to decrease (see equation #2 above). Inserts 8, 9 alone are not effective for certain regimes. It is preferable to use additional stabilizing components in such cases. Thus, the inserts 8 and 9 can be electrically coupled to the cathode-compensator 1 with rectifying components (FIGS. 6, 7) that permit the current to flow from the inserts 8, 9 to the cathode 1. These components may be either a simple diode 18 or a rectifying component 19 with an adjustable range of filtration. The latter provides electron flow from the inserts 8, 9 to the cathode 1 when a specified insert potential is achieved, which gives the accelerator designer the ability to select the most optimal conditions for operating the accelerator. Such component may be an electric schematic with controlled semiconductor device, e.g. semistor.

Figure 9:
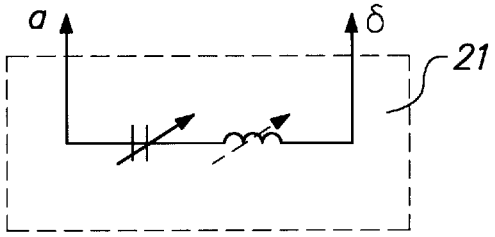

Oscillations in the IAL in the range of 2 kHz to 250 kHz are most intensive and can be suppressed when conducting inserts 8 and 9 are electrically coupled to cathode-compensator 1 by components with low total resistance to AC in this frequency range and with high total resistance to DC. Such coupling components may be capacitor 20 (FIG. 8) or filter circuit 21, where capacitor C and inductor L are connected in series (FIG. 9). By adjusting C and L parameters one can control conditions causing resonance in the circuit, and thus suppress oscillations at the specified frequency. Electrically coupling the inserts 8, 9 and cathode-compensator 1 effectively suppresses potential oscillations in the accelerating channel, thus considerably increasing accelerator efficiency.

Thus implementation of the suggested accelerator embodiment considerably increases efficiency and lifetime of plasma ACEDE type accelerators, and decreases its plume divergence.

The plasma accelerator with closed electron drift described herein can be used in the aerospace industry or for ion plasma material treatment in a vacuum. Use of the invention in aerospace will allow to create electric propulsion systems with adequate lifetime and thrust efficiency for satellite orbit raising and control, stationkeeping, or attitude control. Use of the invention for ion plasma material surface treatment in a vacuum will allow efficient application of coatings on the articles and provide ion support for various processes and operations of selective ion etching for manufacturing of microelectronic devices.

Although the present invention has been described above in terms of specific embodiments, it is anticipated that alteration and modifications thereof will no doubt become apparent to those skilled in the art. It is therefore intended that the following claims be interpreted as covering all such alterations and modifications as falling within the true spirit and scope of the invention.

What is claimed is:

1. A plasma accelerator with closed electron drift, said accelerator comprising:

a discharge chamber having external and internal walls forming an annular acceleration channel, wherein the external and internal walls each have a substantially annular cross section, parts of the internal discharge chamber walls are made of dielectric material, and parts of the internal walls are made of conductive material;

a magnetic system with a magnetic field source, a magnetic path, and external and internal magnetic poles forming an operating gap at an exit part of the discharge chamber walls;

an anode situated inside the acceleration channel at a distance from an exit plane of the discharge chamber exceeding the width of the acceleration channel; and a cathode-compensator in spaced relationship with the anode.

2. The plasma accelerator of claim 1, wherein the internal walls define at least one dividing annular groove between the conductive and dielectric parts.

3. A plasma accelerator of claim 2, further comprising additional annular grooves, wherein screens are located in said additional grooves, said additional grooves being made on a dielectric part of the internal discharge chamber walls between the conductive parts of the internal discharge chamber walls and the anode;

said screens and the internal discharge chamber walls defining a gap between the screens and the internal discharge chamber walls, the gap defining said additional grooves; and the distance between a central plane of the acceleration channel to the screens is not less than the distance from said central plane to the dielectric parts of the internal discharge chamber walls closest to said central plane and located between the conductive parts of the internal discharge chamber walls and the screens.

4. A plasma accelerator of claim 3, wherein the screens are made of conductive material.

5. A plasma accelerator of claim 2, wherein the dividing annular groove is made in such a way so that a straight line connecting any point on a first conductive part on a side of the discharge chamber opposite the dividing annular groove with a point on a second conductive part that defines at least a portion of the dividing annular groove crosses a part of a wall volume forming the dividing annular groove.

6. The plasma accelerator of claim 2, wherein the length of the dividing annular groove along the acceleration channel shall not be less than a value of a Larmor electron radius, the value being calculated using values of discharge voltage and magnetic field induction for the plasma accelerator.

7. A plasma accelerator of claim 6, wherein screens that are located at opposite internal walls of the discharge chamber are electrically coupled to each other, sides of said screens closest to the acceleration channel exit plane being located in a region within which values of the component $B_r$ of the magnetic field induction transverse to the direction of the plasma flow acceleration change from the value of 0.7 $B_{r\ max}$ to the value of 0.85 $B_{r\ max}$ along the central plane of the acceleration channel, where $B_{r\ max}$ is the maximum value of $B_r$ on said central plane.

8. A plasma accelerator of claim 1, wherein the conductive parts of the internal discharge chamber walls are made as inserts of a material resistant to ion sputtering.

9. A plasma accelerator of claim 8, wherein:

the plasma accelerator further comprises at least one dividing annular groove between the conducting parts and the dielectric parts of the internal discharge chamber walls;

the length of the inserts along the acceleration channel does not exceed the length of the region where the values of the component $B_r$ of the magnetic field induction transverse to the acceleration direction along a central plane change from the value of 0.9 $B_{r\ max}$ to the value of $B_{r\ max}$, where $B_{r\ max}$ is the maximum value of $B_r$ along the central plane; and the distance between the central plane and the insert surfaces facing the acceleration channel shall not be less than the distance between the central plane and the dielectric parts of the internal discharge chamber wall closest to the inserts.

10. A plasma accelerator of claim 1, wherein the dielectric parts of the internal discharge chamber walls are made of material with high adhesion capability to particles sputtered from the conductive parts.

11. A plasma accelerator of claim 1, wherein the conductive parts of the internal discharge chamber walls are electrically coupled with the cathode-compensator by a rectifying component adopted to permit flow of electric current from the inserts to the cathode.

12. A plasma accelerator of claim 1, wherein the conductive parts of the internal discharge chamber walls are electrically coupled with the cathode-compensator by electric components having total resistance to AC, at a frequency of between 5 kHz and 250 kHz, less than their total resistance to DC.

13. The plasma accelerator of claim 1, wherein the anode comprises a gas distributor.

14. The plasma accelerator of claim 1, wherein the conductive parts of the internal discharge chamber walls are located near an exit of the discharge chamber.

15. The plasma accelerator of claim 1, wherein parts of the external walls are made of conductive material.

* * * * *